US006039479A

United States Patent [19]

Hill et al.

[11] Patent Number: 6,039,479

[45] Date of Patent: Mar. 21, 2000

[54] PRINTING ASSEMBLY WITH CONTINUOUS STOCK CUTTER AND SHEET FEEDER FOR FEEDING CUT SHEETS TO PRINTER

[75] Inventors: Jeffery L. Hill, Mundeline; Gregory S. Hill, Lake Zurich, both of Ill.

[73] Assignee: Dynetics Engineering Corporation, Inc., Lincolnshire, Ill.

[21] Appl. No.: 09/132,219

[22] Filed: Aug. 11, 1998

Related U.S. Application Data

[62] Division of application No. 08/521,350, Aug. 29, 1995, Pat. No. 5,829,898.

[51] Int. Cl.[7] ..... B41J 11/70

[52] U.S. Cl. ..... 400/621; 271/3.01; 400/611

[58] Field of Search ..... 400/605, 607, 400/621, 624, 625, 611, 618; 271/3.01, 226, 145, 161, 165, 166; 399/384, 385

[56] References Cited

U.S. PATENT DOCUMENTS

| | | | |
|---|---|---|---|
| 580,985 | 4/1897 | Meisel | 101/232 |
| 897,219 | 8/1908 | Meisel | 101/232 |
| 1,962,128 | 6/1934 | Beck | 101/232 |
| 2,050,350 | 8/1936 | Markowitz | 101/232 |
| 2,094,033 | 9/1937 | Zuckerman | 101/224 |
| 2,945,434 | 7/1960 | Eichler et al. | 101/232 |
| 3,072,051 | 1/1963 | Lincoln et al. | 101/227 |
| 3,137,495 | 6/1964 | Eichorn | 271/6 |
| 3,639,055 | 2/1972 | Schliefenbaum | 101/224 |
| 3,998,118 | 12/1976 | Brophy et al. | 83/205 |
| 4,013,006 | 3/1977 | Burrell et al. | 101/227 |
| 4,379,549 | 4/1983 | Mizuma | 271/3.02 |
| 4,968,014 | 11/1990 | Yamakoshi et al. | 271/3.1 |
| 5,014,977 | 5/1991 | Moore et al. | 271/221 |
| 5,134,915 | 8/1992 | Fukano et al. | 83/563 |
| 5,165,675 | 11/1992 | Kanaya | 271/3.1 |
| 5,216,471 | 6/1993 | Kujita et al. | 399/385 |
| 5,216,474 | 6/1993 | Nakao | 271/65 |
| 5,255,903 | 10/1993 | Parsons et al. | 271/10 |
| 5,287,164 | 2/1994 | Watanabe | 271/9 |
| 5,615,961 | 4/1997 | Wada | 400/619 |
| 5,829,898 | 11/1998 | Hill et al. | 400/607 |

*Primary Examiner*—John Hilten
*Assistant Examiner*—Daniel J. Colilla
*Attorney, Agent, or Firm*—James W. Potthast; Potthast & Associates

[57] ABSTRACT

A printing assembly (10) having a printer (30) and a single sheet transport mechanism (22) for automatically transporting discrete sheets seriatim from within a tray held in a tray receptacle (32) to the printer and a discrete sheet load enhancement apparatus with a holder (24) of an auxiliary supply of printable stock (18), a removable open tray (20) with a feed opening (40) accessible for receipt of discrete sheets (14) of printable stock fed within the feed opening while releasably mounted within the tray receptacle and a continuous discrete sheet feeder and producer (16) for automatically feeding the sheets (14) seriatim from the separate supply of printable stock (18) through the feed opening (40) into the removable open tray (20).

5 Claims, 11 Drawing Sheets

PRINTING ASSEMBLY WITH CONTINUOUS STOCK CUTTER AND SHEET FEEDER FOR FEEDING CUT SHEETS TO PRINTER

This application is a division of application Ser. No. 08/521,350, filed Aug. 29, 1995 now U.S. Pat. No. 5,829, 898.

BACKGROUND OF THE INVENTION

FIELD OF THE INVENTION

This invention relates generally to the field of paper printing assemblies and, more particularly, to printing assemblies having a printer which prints information on discrete sheets of paper cut from a continuous paper web stock and fed to the printer.

Description of the Related Art Including Information Disclosed under 37 C.F.R. Section 1.97–1.99

Commercial printing apparatus which cut, or otherwise separate, individual discrete sheets from a continuous paper stock to produce discrete sheets which are subsequently printed upon are known. However, all known desk top or even larger office printing systems commonly operate with continuous stock which carries removable pit holes along an edge for engagement with sprocket drive wheels in order to obtain paper positional control of the sheets. The sheets are first printed upon while the edge strip of sprocket holes are still attached and before the continuous stock is separated into discrete sheets. Various desk top and office printing systems which incorporate laser printers or electrostatic photocopiers print on discrete sheets taken from paper supply trays which retain a supply of precut individual sheets. The precut sheets are manually stacked into the paper supply tray through an open top when the tray is removed from the printer during which time the printer is disabled. After the precut paper sheets are manually stacked into the paper supply tray, the supply tray is manually returned to an operative position within a tray receptacle and the operation of the printer can resume. Thus, the operation of the printer must be stopped each time a stack of precut sheets is manually loaded into the supply tray thereby increasing both printing production time and labor cost. Furthermore, the necessity of the paper being precut into individual sheets or provided with removable sprocket hole strip disadvantageously results in plain (i.e. without sprocket drive hole strip) paper costs significantly in excess of the costs of continuous stock such as rolled or fan-folded stock continuously fed web of printable paper stock inputted to the printer apparatus. Various photocopy and printing assemblies are known to receive paper sheets, either individually precut sheets or separated from a continuous paper web, for printing. U.S. Pat. Nos. 580,985 and 897,219 issued Apr. 20, 1897 and Aug. 25, 1908, respectively, to Meisel show a rotary printing press with cutting and feeding mechanisms which cut a continuous paper stock prior to printing. In U.S. Pat. No. 1,962,128 issued Jun. 12, 1934 to Beck a device is disclosed which cuts wall paper samples prior to printing data upon the samples. U.S. Pat. No. 2,050,350 issued Aug. 11, 1936 to Markowitz shows a paper feeding and cutting apparatus for a printing press.

U.S. Pat. No. 2,094,033 issued Sep. 28, 1937 to Zuckerman shows a roll feeder and cutting device in which a paper web is maintained in a taut condition while feeding and during the cutting operation. In U.S. Pat. No. 2,945,434 issued Jul. 16, 1950 to Eichler et al. a three walled paper tray is shown for a photocopier. A stack of paper sheets are manually loaded at a walled end. The tray has an open end at which the paper sheets are removed for transfer to a photocopy printer, however, the individual paper sheets are only removed and not fed through such open end of the tray. In U.S. Pat. No. 3,137,495 issued Jun. 16, 1964 to Eichorn, in a similar manner to the above Eichler et al. reference, individual paper sheets for a photocopy machine are manually loaded by hand in a stack by removing a paper tray. The paper sheets are removed through open end of the tray. However, the sheets, likewise, are also not fed through the open end of the paper tray.

U.S. Pat. No. 3,072,051 issued Jan. 8, 1963 to Lincoln et al. shows a sheet feeder for a printing machine which cuts, feeds and prints paper sheets. The paper sheets are stacked without the usage of a tray. U.S. Pat. No. 3,639,055 issued Feb. 1, 1972 to Schliefenbaum shows a photocopy machine having a paper copy supplied from a continuous roll in which printing is effected while the paper is moving. U.S. Pat. No. 3,998,118 issued Dec. 21, 1976 to Brophy et al. also discloses a feeder for a photocopy machine which cuts and feeds paper sheets received from a paper roll. U.S. Pat. No. 4,379,549 issued Apr. 12, 1983 to Mizuma shows only a two-sided paper tray which receives a stack of individual paper sheets on a bottom plate from a photocopier.

U.S. Pat. No. 5,014,977 issued May 14, 1991 to Moore et al. shows a paper tray employed in a photocopier system for stopping and stacking sheets fed therein. U.S. Pat. No. 5,134,915 issued Aug. 4, 1992 to Fukano et al. shows a rolled-paper feed unit for an image forming apparatus having a moveable body held in an upper position when feeding rolled paper, and moved to a lower position when resupplying cut paper into a cassette. U.S. Pat. No. 5,216,471 issued Jun. 1, 1993 to Kujita et al. shows an image forming device with a roll paper cutting device having a cutting arrangement for cutting the paper roll and discharging the cut sheets.

U.S. Pat. No. 5,165,675 issued Nov. 24, 1992 to Kanaya shows a paper tray for a photocopy machine which is enabled to provide two sided copies. U.S. Pat. No. 5,216,474 issued Jun. 1, 1993 to Nakao having a single tray for temporarily stacking paper sheets between photocopying operations and as a paper discharging tray for stacking paper sheets subjected to final copying. U.S. Pat. No. 5,287,164 issued Feb. 15, 1994 to Watanabe shows a paper tray for a photocopier which simultaneously holds paper sheets of different sizes. Stacking plates, in an enclosed paper feed cassette, separate the stacked different sized paper sheets. U.S. Pat. No. 5,255,903 issued Oct. 26, 1993 to Parsons et al. shows a sheet feeding apparatus in which a stack of sheets is supported and stored in a biased base tray.

SUMMARY OF THE INVENTION

It is therefore the principal object of the present invention to provide a printing assembly and method in which a discrete sheet printer with a removable discrete sheet supply tray is fed discrete sheets from an external source to overcome the disadvantages of prior assemblies noted above.

The object of the invention is achieved in part by providing a printing assembly having a printer, a single sheet transport mechanism for automatically transporting discrete sheets seriatim from within a removable tray to the printer, and a tray receptacle for releasably mounting the removable tray in operative spatial relationship with the printer and the single sheet transport mechanism, with a discrete sheet load enhancement apparatus, comprising means for holding a separate supply of printable stock apart from the removably mounted supply tray, a removable open tray with a feed opening accessible for receipt of discrete sheets of printable stock within the tray fed through the feed opening while releasably mounted within the tray receptacle and means for automatically feeding discrete sheets seriatim from the separate supply of printable stock through the feed opening and into the removable tray when the removable tray is releasably mounted within the tray receptacle.

Preferably, the removably mounted tray has a base assembly, means for holding the discrete sheets in proper alignment, an open end with said feed opening and a distal end located opposite the open end. Alternatively; the removably mounted four rectilinear walls and a top located opposite the base assembly with said feed opening being accessible for receipt of discrete sheets into the tray through the top when the tray is mounted to the tray receptacle.

Obtainment of the object of the invention is also achieved by provision of a method of printing information on discrete sheets of printable stock by means of a printing assembly having a tray receptacle for releasable mating receipt of a closed tray capable of holding a load of a plurality of discrete sheets of printable stock, a printer and a transport mechanism for automatically transporting sheets from the load of suitable stock held within the tray to the printer for printing, comprising the steps of (a) removing the closed tray from releasable mating receipt with the tray receptacle, (b) inserting an open tray with a feed opening for receipt of discrete sheets into the open tray into releasable mating receipt within the tray receptacle in lieu of the closed tray, (c) automatically feeding discrete sheets into the open tray through the feed opening of the open tray and (d) transporting by means of the single sheet transport mechanism the discrete sheets fed into the open tray to the printer for printing on the discrete sheets.

Also, the object of the invention is obtained by providing a paper supply tray releasably receivable within a tray receptacle of a printing apparatus having a printer and a transport mechanism for moving discrete sheets from within the tray to the printer for receipt of printed information, comprising a base with a closed end and an opposite end with a feed opening for receipt through the open end of discrete sheets and means for guiding discrete sheets received through the feed opening at an open end to a position adjacent the closed end for removal from the tray receptacle.

Moreover, the object of the present invention is achieved by provision of a printer assembly having a tray receptacle for receipt of a removable discrete sheet supply tray, a printer and a single sheet transport mechanism for automatically transporting discrete sheets seriatim from the removable discrete sheet supply tray to the printer for printing, the improvement comprising a removable open tray releasably mountable within the tray receptacle and having a feed opening accessible when the tray is mounted within the tray receptacle for receipt of a discrete sheet from outside of the printer assembly into the tray and a sheet support mechanism for supporting a free and of a discrete sheet partially inserted within the removable open tray receptacle at a level to enable insertion of the removable open tray beneath the partially inserted discrete sheet when the removable open tray is inserted into the tray receptacle.

Preferably, the printer assembly includes means for inserting discrete sheets through the feed opening seriatim with each discrete sheet being partially inserted within the removable open tray while prior discrete sheet remains within the removable tray and the sheet support mechanism includes a sheet support member carried by the discrete sheets inserting means which extends through the feed opening and partially into the removable open tray to support the free and of the discrete sheet partially inserted within the removable open tray.

Also, the object of the invention is obtained by providing a printing assembly having a printer and means for automatically transporting a discrete sheet from a tray to the printer for printing, the improvement being a continuous discrete sheet supply enhancement apparatus, comprising an open tray for receipt of at least one discrete sheet of stock, means for cutting a supply of continuous stock into discrete sheets, means for transferring a free end of the continuous stock to the cutting means at a feed-in speed, means for transporting a discrete sheet cut from the free end of the continuous stock away from the cutting means at a feed-out speed greater than the feed-in speed both to facilitate cutting by placing the continuous stock under strain and to create a gap between a lagging edge of the discrete sheet and a leading edge of the continuous stock from which the discrete sheet is cut, an exit slot at a preselected level, means for ejecting the discrete sheets into the tray from the printer assembly through and out of the exit slot with a time delay between ejection of successively ejected discrete sheets corresponding to said gap, said time delay being sufficiently long to enable each sheet to fall beneath the preselected level of the exit slot and toward the open tray and out of a path of ejection of a next successive sheet being ejected.

BRIEF DESCRIPTION OF THE DRAWINGS

The foregoing objects and advantageous features of the invention will be explained in greater detail and others will be made apparent from the detailed description of the preferred embodiment of the present invention which is given with reference to the several figures of the drawing, in which.

DETAILED DESCRIPTION OF THE PREFERRED EMBODIMENT

Figure 1:
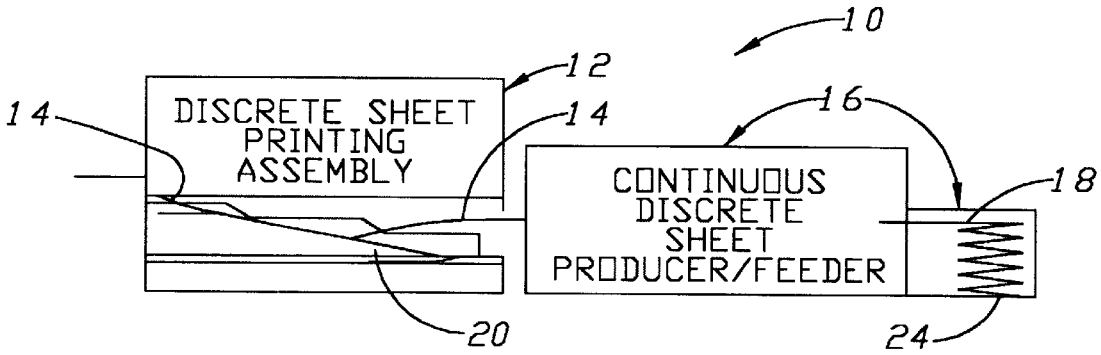
FIG. 1 is a schematic of the continuously fed sheet printing assembly of the present invention.

Referring to FIG. 1, the automatic, continuously fed, sheet printer assembly 10 of the present invention is seen to include a known discrete sheet printing assembly 12 with a printer or printing mechanism for automatically printing information on discrete sheets 14 of printable stock fed to the printing assembly and a novel apparatus including a continuous discrete sheet producer/feeder 16 for producing the discrete sheets 14 from a supply of continuous printable stock 18, preferably a supply of fan-folded paper, as shown. Alternatively, the continuous printable stock is in the form of a continuous roll of paper or a series of interconnected rolls of paper or other medium upon which information can be transferred by means of impact printing or otherwise. The discrete sheets are fed to the discrete sheet printing assembly 12 by pushing them out of the continuous discrete sheet producer/feeder 16 and into an open end of a three walled tray 20 and into a position for removal from within the tray by a known discrete sheet transport mechanism 22, FIG. 2.

As seen in FIG. 1, the printer assembly 10 includes a continuous printable stock supply holder 24 for holding an auxiliary supply of printable stock 18. Unlike conventional discrete sheet printer assemblies incorporating a laser printer for printing a stacked supply of individual sheets retained in an enclosed four-walled paper tray retained within the printer housing, an auxiliary supply of printable stock 18 is held by printable stock supply holder 24 at a distance apart from the removably mounted supply tray 20. The continuous discrete sheet producer/feeder 16 of the present invention automatically feeds discrete sheets seriatim from the auxiliary supply of printable stock 18 through a feed opening into the removably mounted paper supply tray 20 when the tray is mounted and releasably secured in the tray receptacle of the discrete sheet printing assembly 12.

Figure 2:
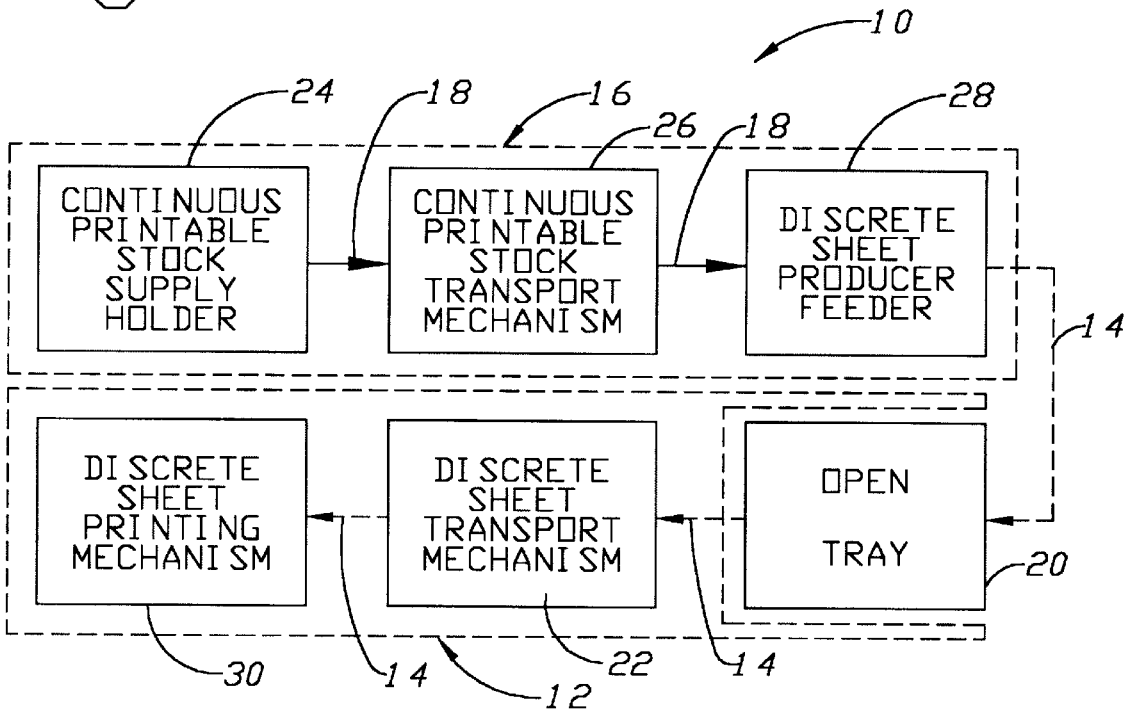
FIG. 2 is a detailed block diagram of the continuously fed printing assembly of the present invention.
Figure 6:
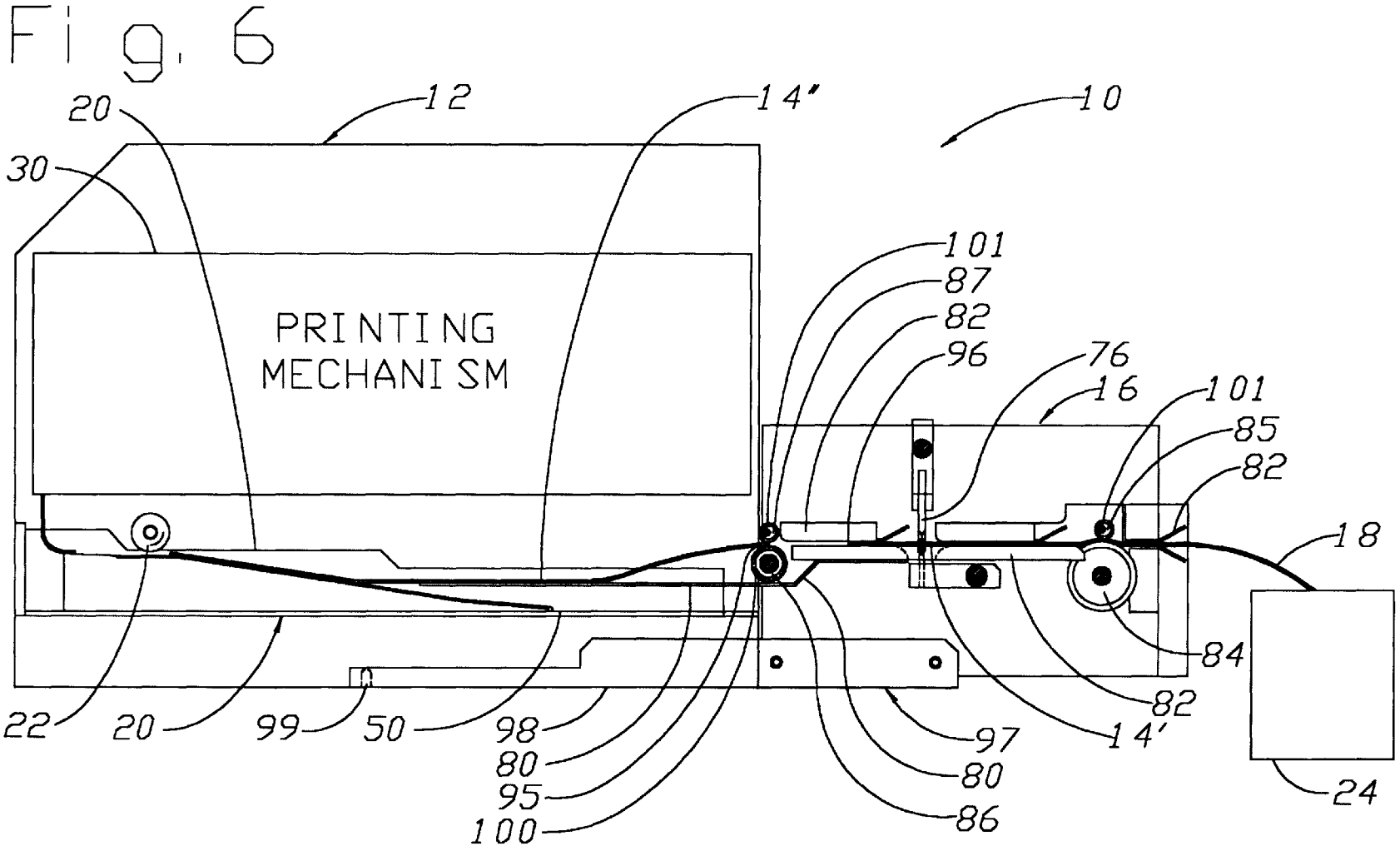
FIGS. 6 and 7 are side views of the automatically continuously fed sheet printing assembly of the present invention.
Figure 7:
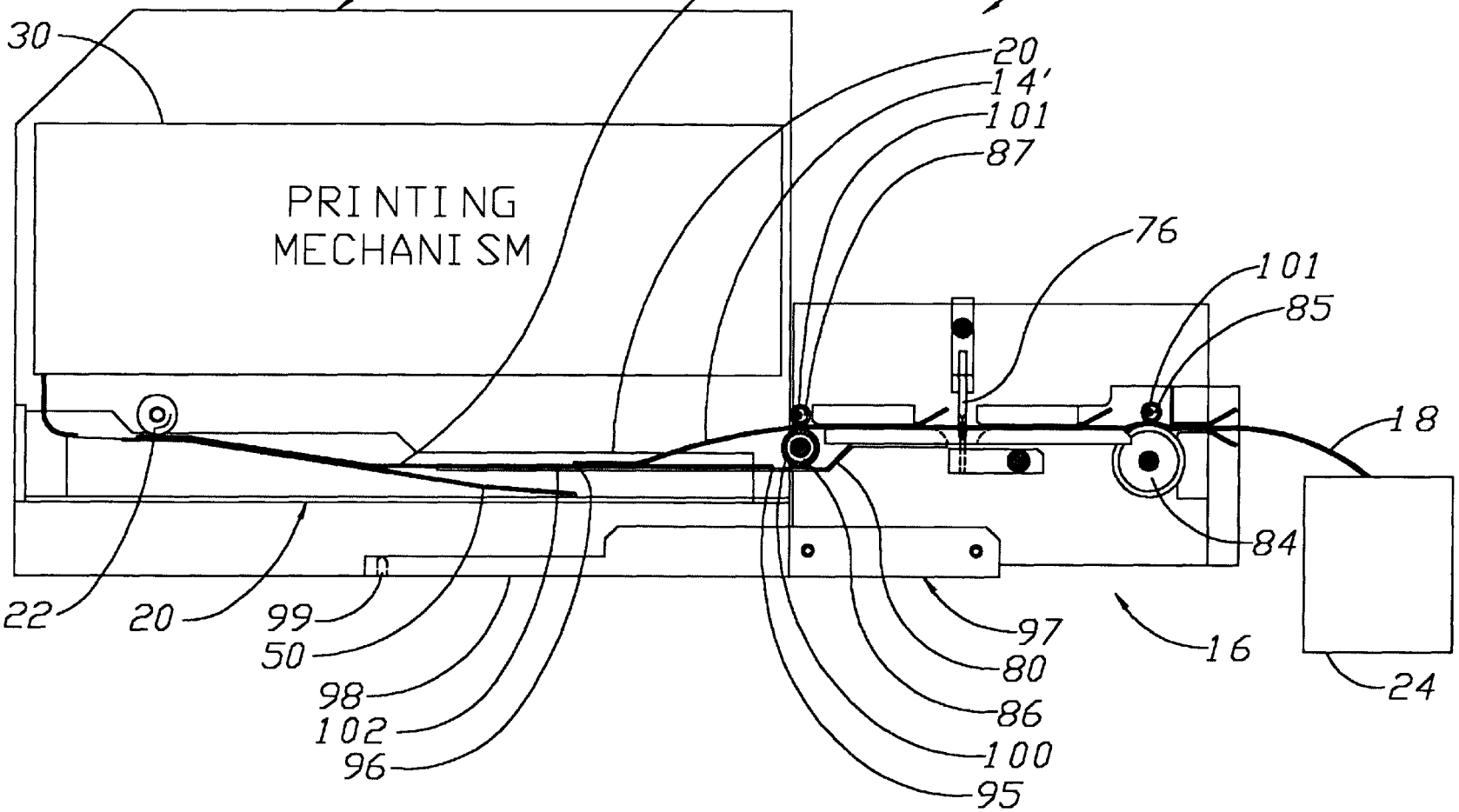

Referring now to FIG. 2, the discrete sheet printing assembly 16, of the printer apparatus 10, is shown in greater schematic detail in which the continuous supply of printable stock 18 or fan-folded supply of paper held in the printable stock supply holder 24 is attached as a continuously folded or rolled sheet to a continuous printable stock transport mechanism 26. Preferably the continuous printable stock transport mechanism selectively includes a plurality of rollers for moving the continuous printable stock 18 represented by solid arrows in FIG. 2, to a discrete sheet producer and feeder 28 as is shown in FIGS. 6 and 7. The discrete sheet producer and feeder 28 also selectively includes a paper sheet separator/cutter or burster mechanism for separating individual, single, discrete sheets from the continuous printable stock 18 and a plurality of rollers to feed the separated discrete sheets to a removably mounted, open ended supply tray 20 positioned within the discrete sheet printing assembly 12.

The discrete sheet printing assembly 12 includes a discrete sheet transport mechanism 22 and a discrete sheet printing mechanism or printer 30. The discrete sheet printing assembly, preferably an electronic laser printer 12 has a conventional, single sheet transport mechanism 22 for automatically transporting discrete sheets received within the supply tray 20 seriatim to the printing mechanism 30, also called the printer. The present invention includes a novel, discrete sheet load enhancement apparatus having the continuous, discrete sheet producer/feeder 16 and the removably mounted open supply tray 20.

The supply tray 20 is releasably secured within a tray receptacle 32, FIG. 3, of the discrete sheet printing assembly 12 and holds an individual, single, discrete sheet 14 for removal to the printing mechanism 30 by the single sheet transport mechanism 22. The tray receptacle 32 mounts the removable supply tray 20 in an operative spatial relationship with the printer 30 and the single sheet transport mechanism 22. Preferably, the discrete sheet printing assembly 12 is an ECOCYS A-SI® printer brand laser printer model FS-3600 or FS-3600A manufactured by Kyocera Corporation. However, any alternative laser printer assembly 12 having a suitable, single sheet transport mechanism 22 for carrying individual sheets stored in a receptacle tray 20 to a printing mechanism 30 for printing of information on the surface of the sheets may readily be employed. The individual, single sheets 14 are transported from the tray 20 to the printing mechanism 30 by pickup rollers of the discrete sheet transport mechanism or by any other suitable means provided by the laser printer device 12. The printing mechanism or printer 30 of the ECOCYS® brand laser printer 12 of the present invention utilizes PEERLESS PRINT5® to provide HEWLETT PACKARD LASER JET® Compatible PCL5 language emulation for printing information on a received discrete sheet of paper stock 14.

Figure 3A:
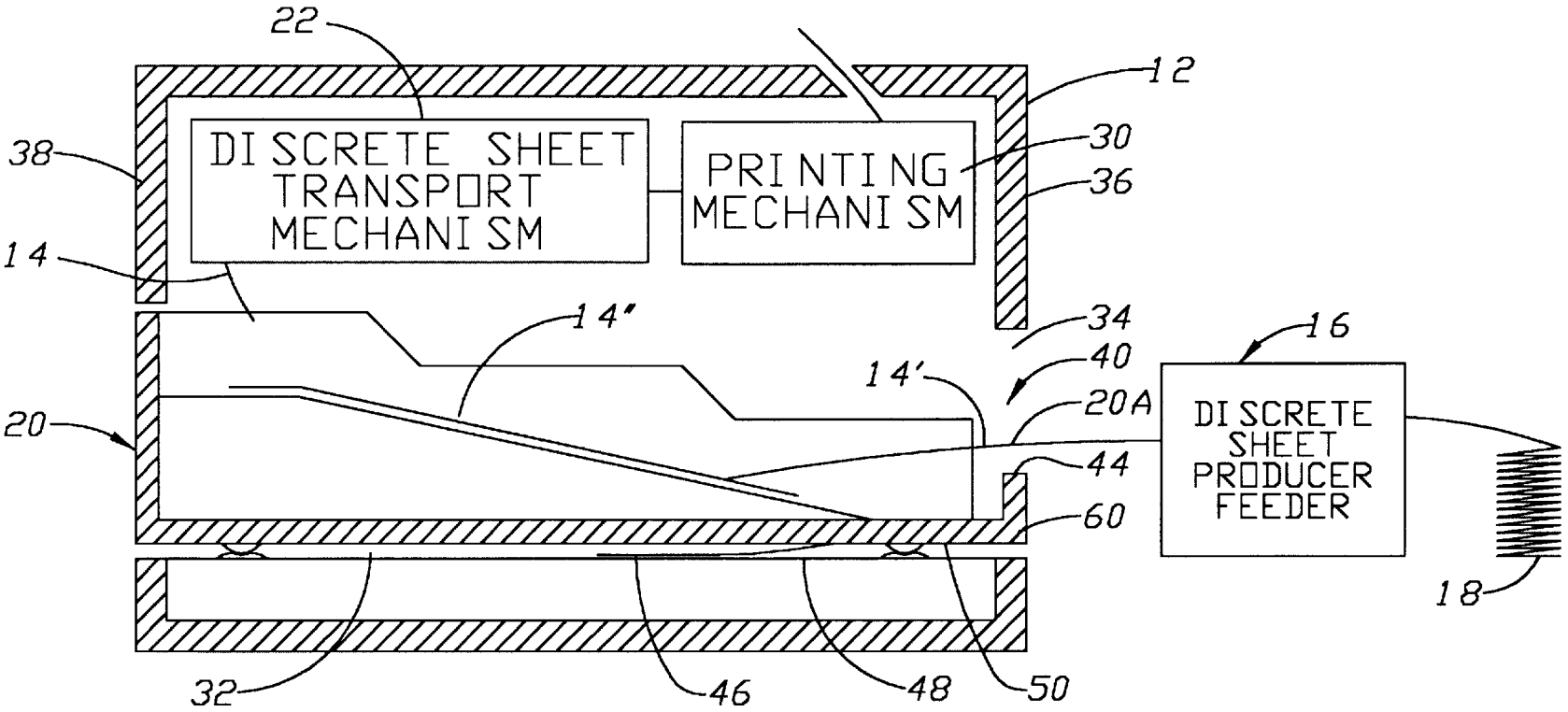
FIG. 3A illustrates the discrete sheet printing assembly receiving a fed sheet with an inserted open tray.

Referring to FIG. 3A, the supply of printable stock 18 is shown to be inserted into the discrete sheet producer/feeder 16 for producing discrete sheets 14, 14' and 14" from the auxiliary supply of continuous stock 18. The separately cut discrete sheets 14 are fed into an opening 34 at the back end 36 of the sheet printing assembly 12 and received one by one at the open ended tray 20 positioned therein. The removably mounted open tray 20 is inserted at a front end 38 of the laser printing assembly 12. The removably mounted tray 20 has a feed opening for receipt of discrete sheets 14 automatically fed by the discrete sheet producer/feeder 16 when the tray is releasably mounted in the tray receptacle 32.

Figure 5A:
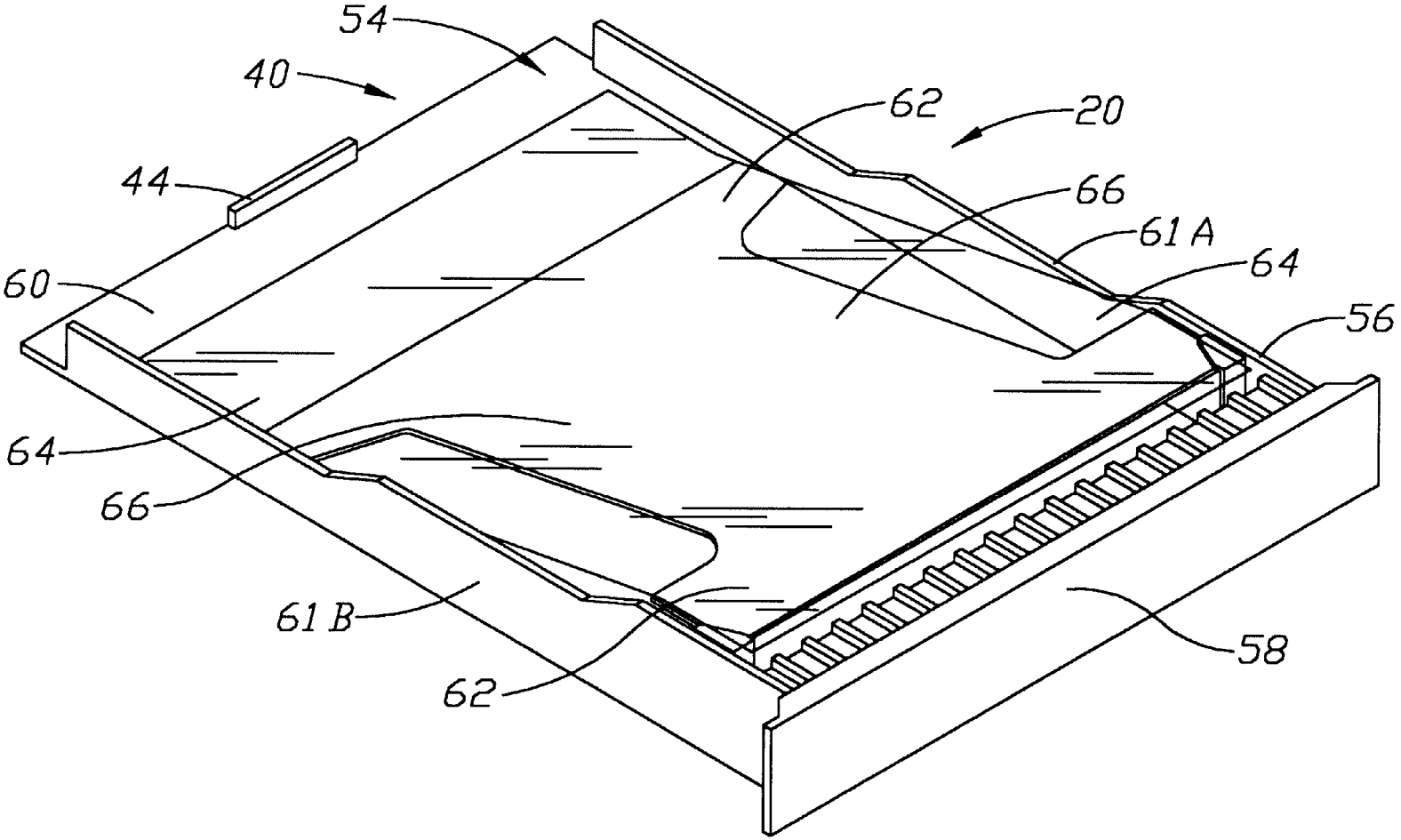
FIGS. 5A, 5B and 5C are of the open tray of the present invention.
Figure 5B:
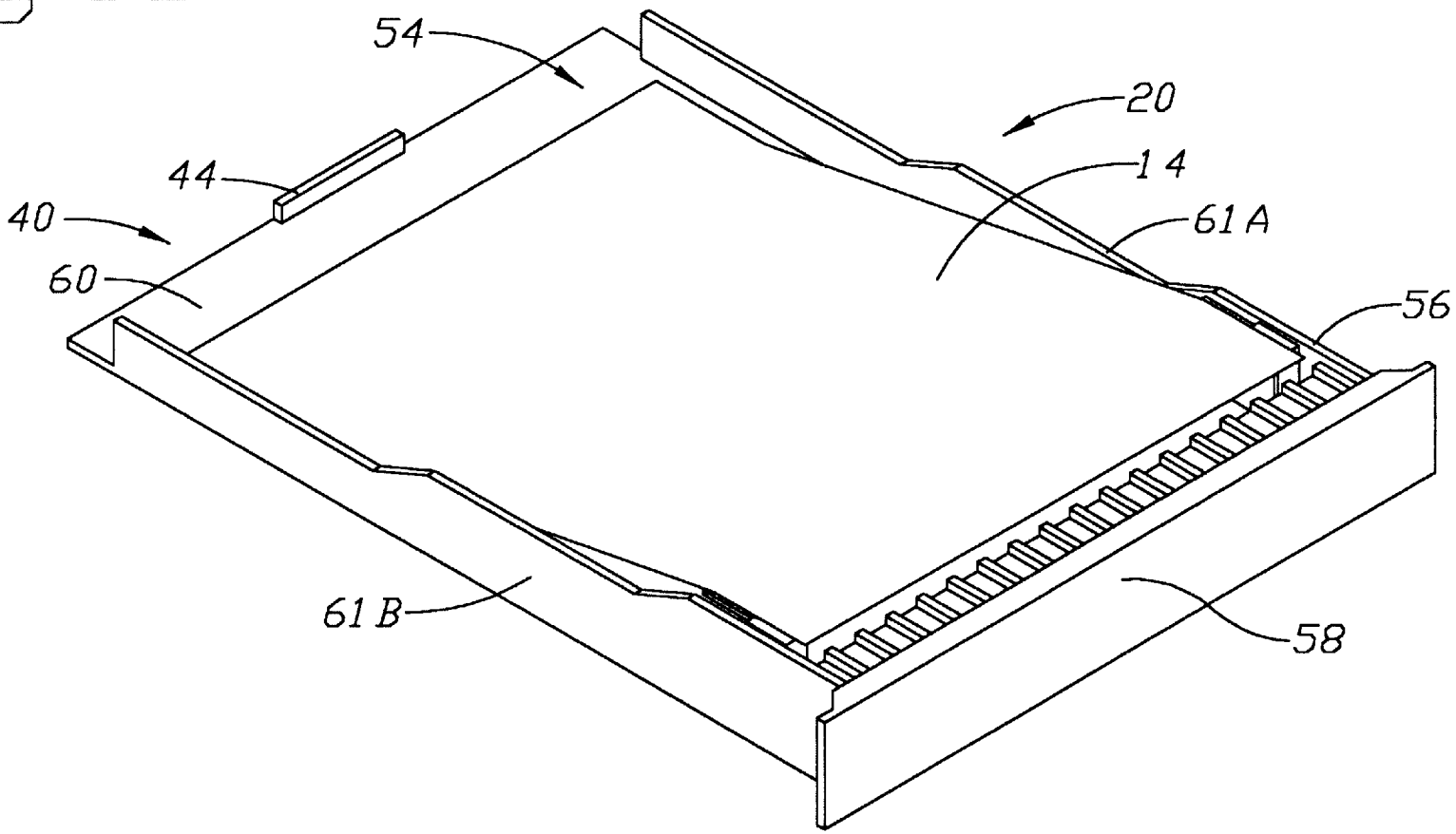
Figure 5C:
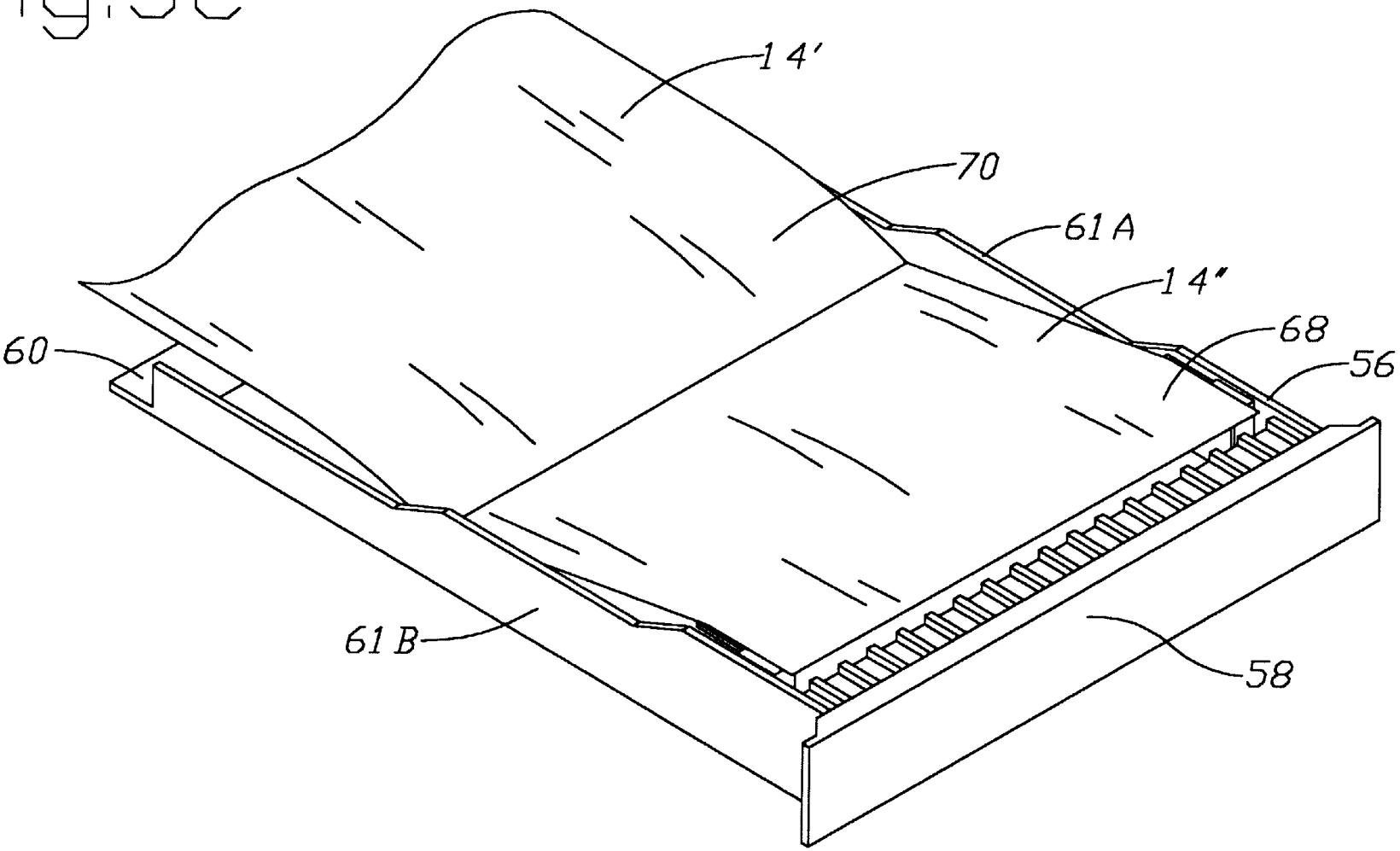

The open end 60 of the tray 20 enables individual sheets to be fed through the opening 34 at the back end 36 of the laser printer assembly 12. As seen in FIGS. 5A–5C, the releasably securable tray 20 is a three walled tray having the feed opening 40 for receipt of a separated discrete sheet 14 to be printed by the printer 30 of the laser printing assembly 12 . In conventional alternative printing arrangement, a four-walled closed tray (not shown) without an open end which houses a stack of precut sheets is inserted at the front end 38 of the laser printing assembly 12 for printing. The tray receptacle 32 of the present invention is configured such that the open ended three walled tray 30 of the present invention is enabled to receive individual sheets 14 produced from a printable stock 18 through the housing opening 34 of the printer and the feed opening 40 defined by open end 60 of the tray 20 in lieu of such four-walled tray. The open ended tray 20 is removably received within the tray receptacle 32 in lieu of the closed four-walled tray (not shown) generally used to hold a supply of discrete sheets and which is inserted from the front 38 of the discrete sheet printing assembly. The noted four-walled tray extends to the back end 36 where it acts as a wall effectively closing and sealing off the receptacle opening 34 thus not permitting individually separated sheets to be inserted through the back end 36.

As seen in FIG. 3A, the discrete sheet producer/feeder 16 holds a partially inserted sheet 14' which has its leading end received through the feed opening 40 and positioned within the tray 20. While the partially inserted discrete sheet 14' is awaiting to be fully positioned into the tray 20, a preceedingly produced sheet 14" is fully inserted and lies across a smooth glide surface 42 of the tray. A relatively low level stop member 44 at the back end of the open ended tray 20 blocks the inserted discrete sheet 14", once moved into the open tray 20 through open back end 36, from sliding out or being pulled back out of the open end by feed rollers (FIG. 6) of the discrete sheet producer/feeder 16.

Immediately prior to the initiation of the complete feeding of the partially inserted sheet 14' into tray 20 the fully inserted sheet 14" is removed from the tray by the discrete sheet transport mechanism 22. The discrete sheet transport mechanism 22 removes the fully inserted sheet from the tray 20 and carries it to the printing mechanism 30 for electrostatic or impact printing of information thereon. The printed discrete sheet 14 subsequently is dispensed through a top outlet of the discrete sheet printing assembly 12. A spring biased resilient member 46 secured to a bottom portion 48 of the tray receptacle 32 and is held in a downright position by the bottom 50 of the open ended tray 20. As seen in FIG. 3A, the spring biased resilient member 46 is in an inoperative position in which the resilient member is held down by the bottom portion 50 of the removable tray 20 when the tray is inserted in the receptacle 32.

Figure 3B:
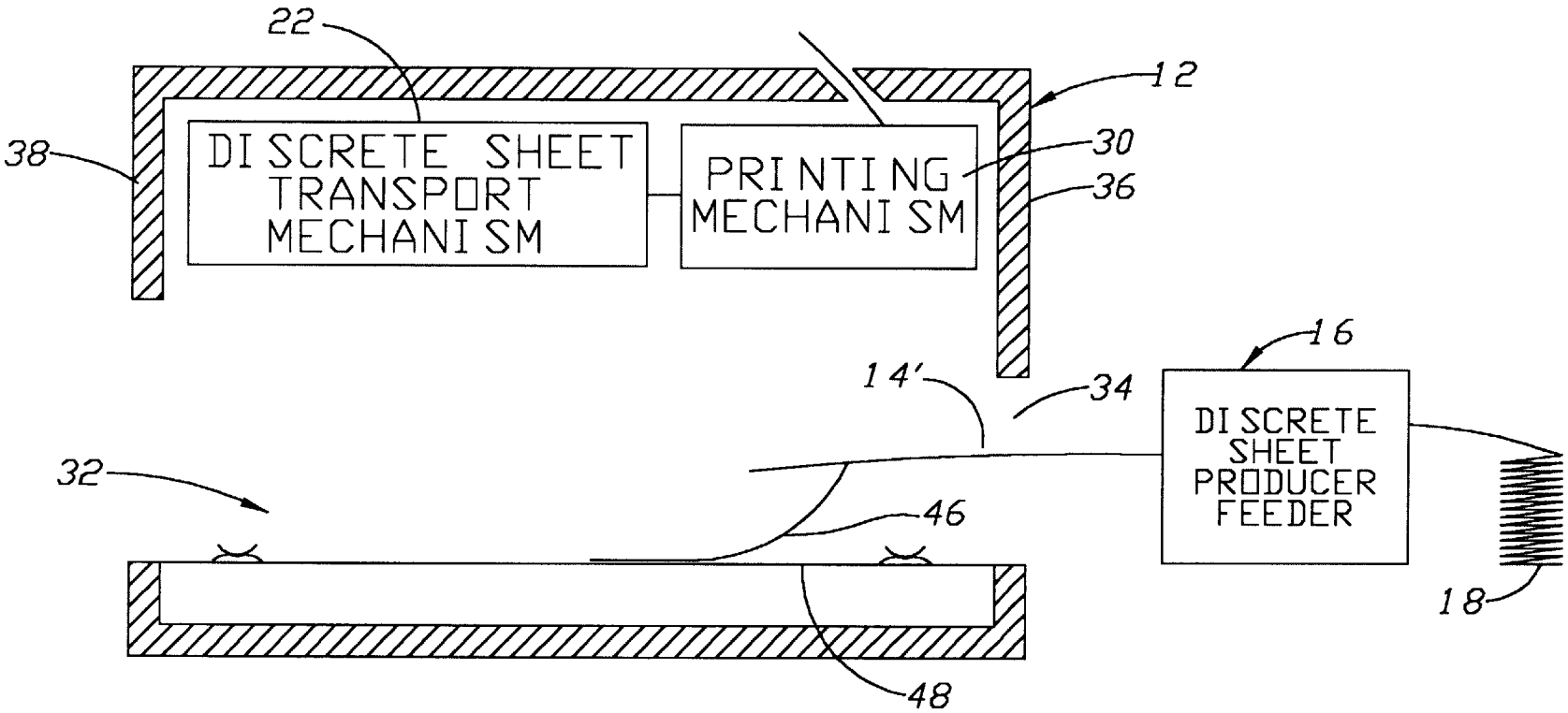
FIG. 3B represents the discrete sheet printing assembly receiving a fed sheet with the open tray removed.

Referring now to FIG. 3B, the spring biased resilient member 46 is shown holding the partially inserted sheet 14' in the extended upright position when the open tray 20 is removed from the tray receptacle 32. When the open ended tray 20 is removed from the receptacle 32 the resilient member 46 which is held down by the bottom 50 of the tray 20, automatically springs up into an operative position to support the free leading edge 52 of sheet 14' above the top of the stop member 44. The configuration of the removably mountable tray 20, FIG. 3A, is such that the opening 34 of the receptacle 32 is accessible when the tray is mounted in the receptacle to receive a discrete sheet 14' from outside of the laser printing assembly 12. As seen in FIG. 3B, the resilient member 46 supports the leading free end 52 of partially inserted sheet 14' within the tray receptacle 32 at a level or height which enables the tray 20, FIG. 3A, to be inserted beneath the partially fed discrete sheet 14' when the tray is placed in the receptacle. By elevating the partially inserted sheet 14', by means of the resilient member 46, the sheet 14' will not be damaged or crumpled when the open ended tray 20 is inserted in the receptacle 32. This prevents the vertically extending stop member 44 from making contact with and damaging the partially inserted paper sheet 14' upon positioning of the tray 20 in the receptacle 32.

The method of printing information on discrete sheets in open ended tray 20 is accomplished in the discrete sheet printing assembly 12 of the present invention which is enabled to also print sheets from a closed tray (not shown) and capable of holding a stacked load of individual sheets is preferably performed by: removing the closed tray from releasable mating receipt with the tray receptacle 32; inserting the open tray 20 having feed opening 40 into releasable mating receipt within the tray receptacle 32 in lieu of the closed tray; automatically feeding discrete sheets 14 into the open tray 20 through the feed opening 40 of the tray; and transporting with the single sheet transport mechanism 22 the discrete sheets 14 fed into the open tray to the printing mechanism 30 for printing on the discrete sheets. In performing this method of printing, preferably the open ended tray 20 is an entirely separate tray apart from the enclosed tray. Alternatively, the closed tray is opened, by removal of a top piece, a wall portion of the closed tray, or any other suitable manner to convert the closed tray into an open tray before inserting the converted open tray into releasably mating receipt within the tray receptacle 32.

As seen in FIG. 3A, the method of printing performed at the discrete sheet printing assembly 12 of the present invention includes the steps of feeding a discrete sheet 14" into the one tray 20 as the sheet 14" falls out of a path of ejection from the discrete sheet produced feeder 16 and into the open tray 20, and partially inserting the next successive discrete sheet 14' into the open tray 20 after the immediately prior sheet 14" has fallen into the open tray and out of the path of ejection but prior to having been removed from the tray by the sheet transport mechanism 22. As seen in FIG. 3B, the method includes the step of supporting the partially inserted discrete sheet 14' within the tray receptacle 32 above an uppermost portion of the base proximate the open end region of the tray 20 which underlies a received sheet 14", FIG. 3A, when the tray 20 is inserted into the receptacle 32.

Figure 4:
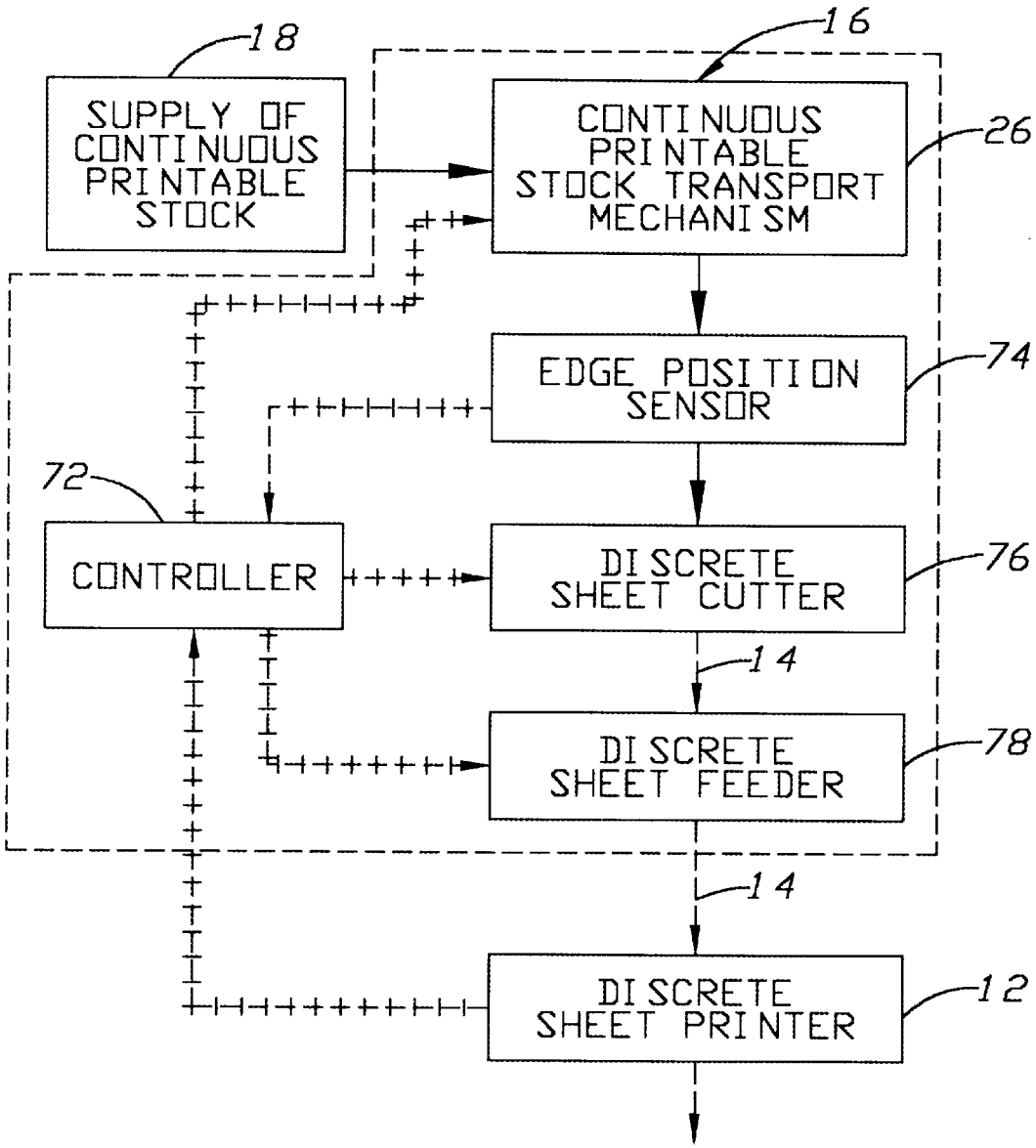
FIG. 4 is a block diagram of the continuous discrete sheet producer feeder.

Referring to FIG. 4, the continuous discrete sheet producer/feeder 16 is schematically shown receiving a paper supply of continuous printable stock 18, preferably in the form of a fan-folded paper supply. The continuous discrete sheet producer/feeder 16 separates the received supply of fan-folded stock 18 (represented by solid arrows in FIG. 4) into individual discrete sheets 14 (represented by dashed arrows) and transports the discrete paper sheets 14 to the discrete sheet printer assembly 12 for printing of information thereon. The discrete sheet producer/feeder 16 has an electronic central controller 72 for sending and receiving various electronic signals (represented by ++++ arrows) to the continuous printable stock transport mechanism 26, the paper position sensor 74, discrete sheet cutter 76 and the discrete sheet feeder 78. Preferably, the electronic central controller is a based controller with an associated memory and programmed to execute the operations at the continuous discrete sheet producer/feeder 16.

The central controller 72 directs the continuous printable stock transport mechanism 26 to feed the received supply of printable paper stock 18 through the discrete sheet producer/feeder 16. Preferably, the continuous printable stock transport mechanism 26 includes a plurality of pinch rollers driven along a shaft by a chain and sprocket assembly powered by an electric motor coupled to the central controller or by other suitable means for transporting the supply of printable stock to the producer/feeder 16. As the printable stock transport mechanism 26 conveys the printable stock 18 through the sheet producer/feeder 16 the printable paper stock is continually sensed by a position sensor 74.

Figure 8:
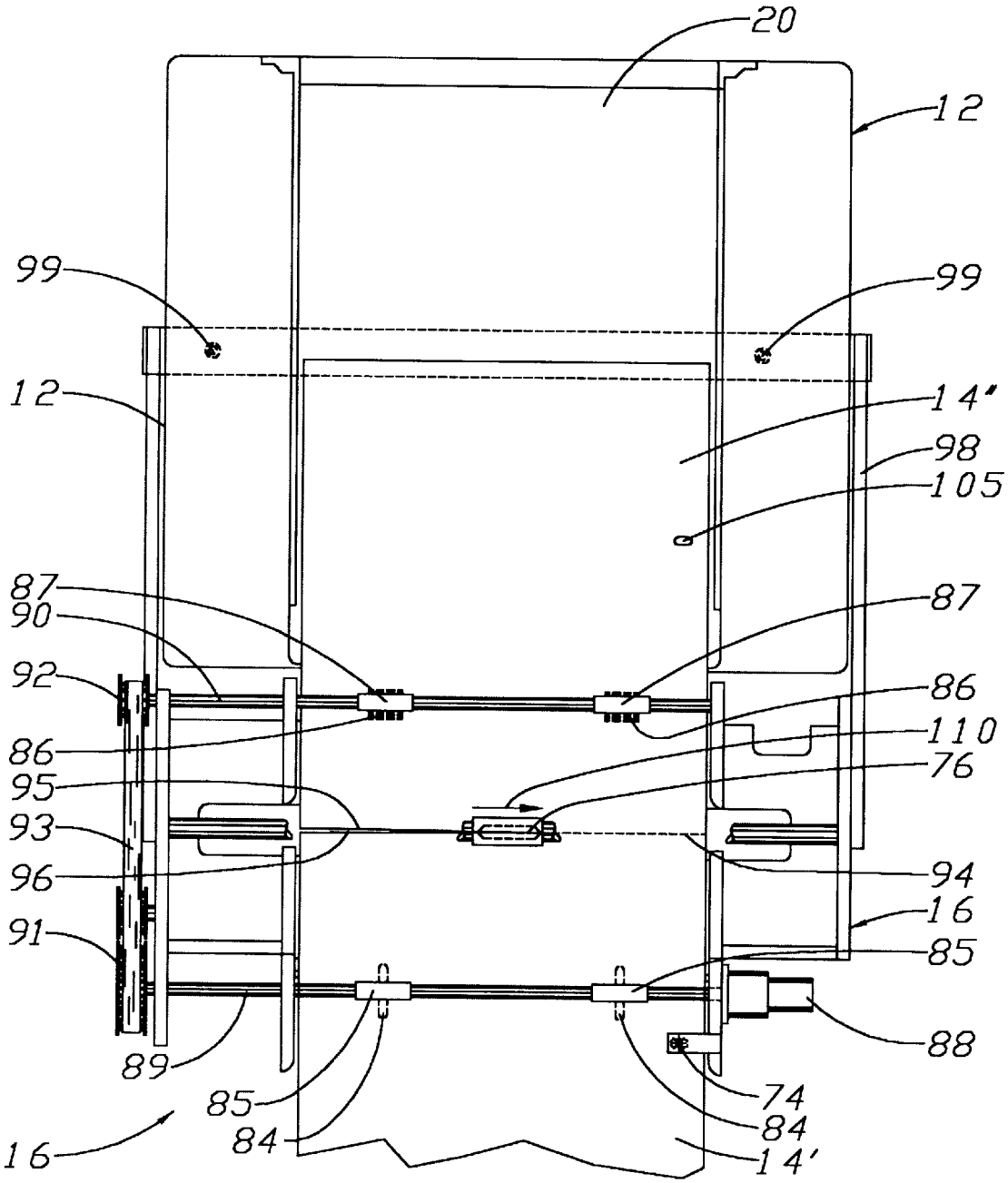
FIGS. 8 and 9 are top views of the continuous discrete sheet producer/feeder illustrating the separation of discrete sheets and insertion into the open tray of the printer assembly of the present invention.
Figure 9:
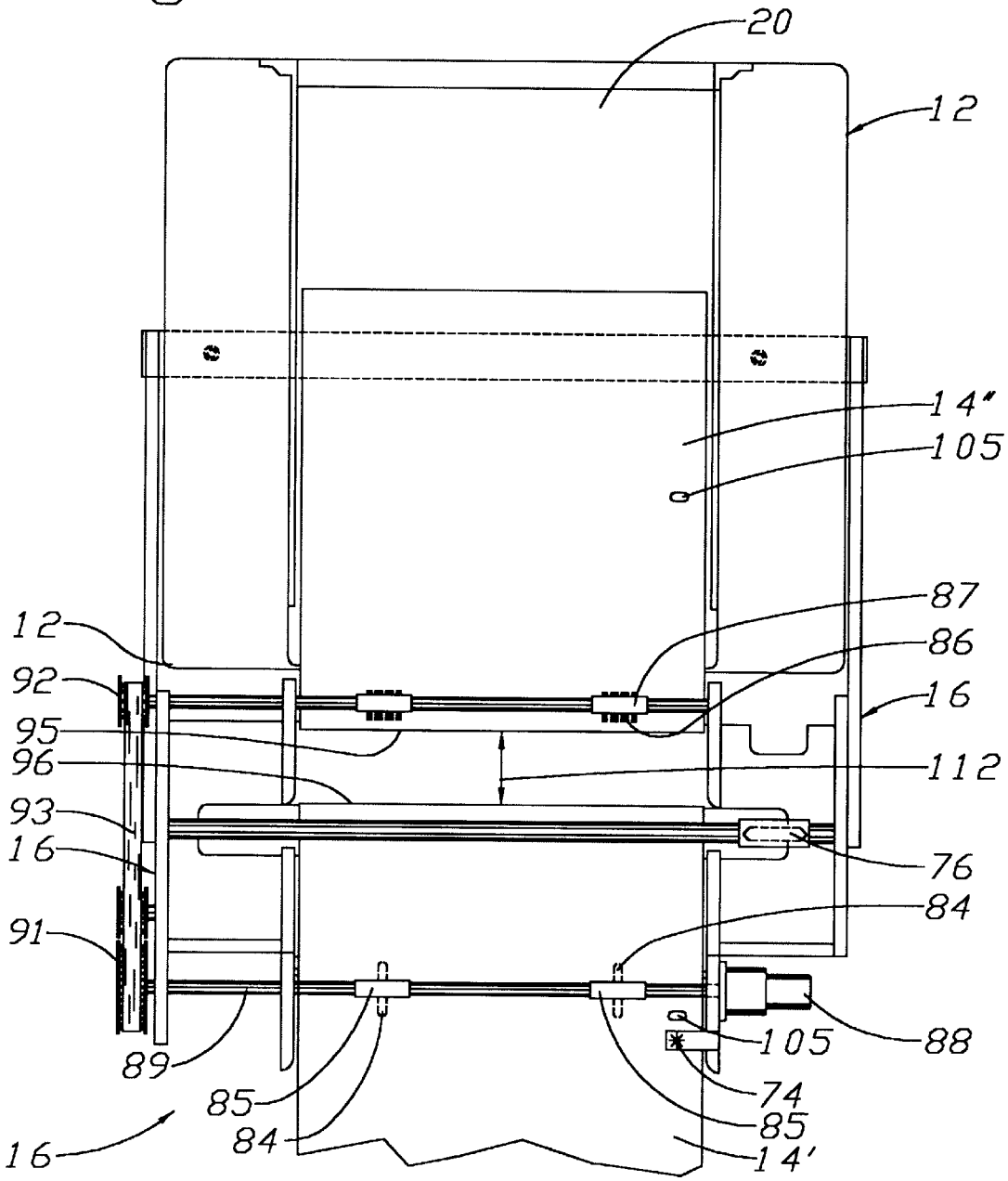

The position sensor 74 senses a hole opening or other distinct marking on the surface of the fan-folded or rolled printable paper stock 18. Upon sensing the hole or other suitable marking, the position light sensor 74 sends a signal to the central controller 72 which automatically signals the continuous printable stock transport mechanism 26 to temporarily cease the transport of the printable stock 18 at the sheet producer/feeder 16. The continuous discrete sheet producer/feeder 16 is configured such that when the position sensor 74 senses the hole or appropriate marking on the paper fan-fold of printable stock 18, the leading edge of the identified sheet carrying the marking is aligned with the discrete sheet cutter 76. Accordingly, when the light sensor 74 is activated and the controller 72 signals the stock transport mechanism 26 to stop running, the central controller also signals the discrete sheet cutter 76 to move across the width of the printable stock 18 thereby separating the paper stock into individual discrete sheets. The discrete sheet cutter 76 preferably moves along perforations which identify the edges of the discrete paper sheets when separating the sheets along the edges. The discrete sheet cutter is preferably in wire, pointed edge block, blade or other suitable sharp item which moves across the width of the paper stock through the employment of a motor which enables movement of securing blocks carrying the cutter across slidable support rods extending the width of the discrete sheet producer/feeder as seen in FIGS. 8 and 9 or by any other suitably conventional sheet separation means.

The central controller is timed to begin transport of the continuous printable stock once the leading discrete sheet has been separated. Once a sheet has been separated from the printable stock 18 by the discrete sheet cutter 76 the central controller 72 signals the continuous printable stock transport mechanism 26 to move the next sheet of the continuous printable fan-folded stock 18 through the sheet producer/feeder 16 until the appropriate markings are sensed on the next sheet and the next sheet is subsequently cut from the stock. The discrete sheet 14 separated from the continuous printable stock by the sheet cutter 76 is carried by a discrete sheet feeder 78 to the discrete sheet printer assembly 12. Preferably, the discrete sheet feeder 78, as seen in FIGS. 6 and 7, includes a plurality of rollers which pinch the discrete sheet and feed it to the printer assembly 12 through the employment of a drive shaft, drive chain and sprocket assembly powered by an electric motor in a similar operative manner as in the continuous printable stock transport mechanism 26.

The discrete sheet printer assembly 12 having a removably insertable open paper tray 20, FIG. 3, receives a single discrete paper sheet at the open end 60 of the tray from the sheet feeder 78. The single sheet 14 is removed from the tray 20 by the discrete sheet transport mechanism 22, FIG. 1, and carried to the discrete sheet printing mechanism 30 of the printer assembly 12 to print appropriate information on the single discrete paper sheet. Upon the laser printer or printer assembly 12 sensing the removal of the single discrete sheet 14 from the supply tray 20 and determining that the supply tray is empty, the internal microprocessor of the laser printer signals the central controller 72 of the discrete sheet producer/feeder 16 to continue to feed an additional discrete paper sheet into the removably mounted supply tray 20. The central controller 72 enables the sheet producer/feeder to automatically feed a discrete sheet cut from the continuous supply stock 18 into the removably mounted tray 20 in response to each time the tray is sensed as being empty.

Referring now to FIG. 5A, an empty paper supply tray 20 is shown having a base 54 with a closed end 56 having an end wall 58 extending between a pair of side walls 61A, 61B on opposite sides of the base 54. Distally opposite of the closed end 56 is open end 60 defining the feed opening 40 at which discrete sheets are inserted by the sheet producer feeder 16, FIG. 3A. The pair of side walls 61A, 61B enable the discrete sheet 14 to be held in proper alignment when inserted in the removable paper supply tray 20.

Stop member 44 is secured adjacent the open end 40, and extends upwardly from the base assembly 54 of the tray 20. The stop member 44 located adjacent the open end 40 of the paper supply tray 20 acts to block removal of a discrete sheet 14 through the open end 40 thereby preventing inserted sheets from sliding out of the open back end of the tray and towards the feed rollers of the discrete sheet producer/feeder 16, FIG. 3A.

Angled upwardly from the base 54 towards the closed end 56 of the tray 20 is a generally H-shaped, support member 62 made of metal, plastic or suitable material for supporting a single discrete sheet 14 in an angled position within the tray 20. Lying entirely atop the generally H-shaped support member 62 and extending from the closed end 56 to a position proximate the opposite open end 60 is glide member 64. The glide member 64 supported above the bottom of the base 54 by support mechanism 62, is preferably a thin sheet of plastic having a substantially smooth upper surface 66 for facilitating sliding movement of a discrete sheet 14, FIG. 5B, from the open end 60 along the glide to the distal closed end 56 at which the discrete sheet 14 is removed from the open paper supply tray 20 by the single sheet transport mechanism 22, FIG. 3A. The glide 64 formed of a flexible sheet of plastic-like material having substantially the same shape and size of the discrete sheets 14 which overlies the support mechanism 62 in lieu of a discrete sheet.

The glide member 64 having smooth upper surface 66 is slanted and extends upwardly toward the distal closed end 56 from adjacent the base 54 at the open end 60. The smooth surfaced glide member 64 in conjunction with the side walls 61A, 61B extending between base 54 enable discrete sheets 14 received within the tray 20 through feed opening 40 to be guided to a position for removal from the tray in receptacle 32 by the sheet transport mechanism 22, FIG. 3A.

Referring now to FIG. 5B, a single discrete sheet 14 is shown inserted in position in the paper supply tray 20. The sheet 14 inserted at open end 60 through opening 40 is slidably moved along the smooth surface of the glide member 64, FIG. 5A, into the front closed end 56 of the paper supply tray 20. FIG. 5C, illustrates the positioning of the inserted sheets 14' and 14" just prior to removal by the single sheet transport mechanism 22 for printing of fully inserted sheet 14" as described in FIG. 3A.

The fully inserted sheet 14" is positioned for removal at its leading end 68 by the single sheet transport mechanism 22. The partially inserted sheet 14' has approximately one half of its body inserted through open end 60 with its leading end 70 either supported within the tray receptacle or gently resting atop of sheet 14 while the opposing lagging end of sheet 14' is being separated from the fan fold of printable stock 18 by the discrete sheet producer/feeder 16 as described in FIG. 3A. This arrangement of having one half of a sheet 14' inserted into the tray receptacle area as shown in FIG. 5C, enables an individual sheet 14' to be quickly inserted into the tray 20 once the previous sheet 14" is removed to be printed. The printer assembly is timed such that when a fully inserted sheet 14" is removed at its leading end 68 out of the tray 20 for printing, the next partially inserted sheet 14' is immediately fully positioned in the tray for its subsequent printing. Alternatively, when the internal microprocessor of the laser printer device or discrete sheet printing assembly 12 determines that the tray 20 is empty of any sheets, a signal is sent to the controller 72 of the discrete sheet producer/feeder 16, FIG. 4, to initiate the step of feeding a new discrete sheet into the tray each time the tray is sensed to be empty.

Referring now to FIG. 6, the printing assembly 10 is shown illustrating the continuous discrete sheet producer/feeder 16 receiving a fan folded stock of paper sheets from a printable paper stock supply holder 24 to produce individual discrete sheets which are then fed through the open end of tray 20 inserted in the discrete sheet printer apparatus 12. FIG. 6 also shows a previously cut discrete sheet 14" being completely ejected from the continuous discrete sheet producer feeder 16 and into the open tray 20 for subsequent transport for printing. The next successive sheet 14' which is part of the continuous printable stock 18 is shown being moved through the separation path of the discrete sheet producer feeder 16 as it approaches the position to be cut.

The fan folded supply of printable stock 18 is positioned within the discrete sheet producer/feeder 16 by various guide members 82 and carried along a sheet production path by means of a plurality of rollers 84, 85, 86, 87. A first set of rollers includes larger feed-in drive rollers 84 and eccentric tension rollers 85 and the second set of rollers includes relatively smaller feed-out drive rollers 86 with associated eccentric tension rollers 87. As better seen in FIGS. 8 and 9, a motor 88 operates to run drive shafts 89, 90 connected by sprockets 91 and 92 respectively through means of drive belt 93. Alternatively, a drive chain and sprocket assembly or any other conventionally suitable means of running drive rollers 84 and 86 may be used. The feed-in drive roller 84 is relatively larger than the feed-out drive roller 86. The feed-in roller 84 is driven to rotate at a feed-in speed which is slower than the feed-out speed of the relatively smaller feed-out drive roller 86.

Initially the fan folded supply of continuous paper stock 18 is guided through the discrete sheet producer/feeder 16 by the lower feed-in drive roller 84 and the corresponding eccentric tension roller 85. The first set of rollers 84, 85 transfers a free end of the continuous paper stock to the second set or feed-out roller 86 rotating at a faster speed than the feed-in rollers until a perforated edge 94 of sheet 14' which is still connected to the continuous stock is sensed to be aligned with the discrete sheet cutter 76, as described in FIGS. 8 and 9. When the perforated edge 94 of the sheet 14' is sensed to be aligned with the cutting blade 76 the drive rollers 84, 86 are signalled to stop rotating and the cutting blade is enabled to move horizontally across the width of the paper stock 18 thereby separating an individual discrete sheet. Once the discrete sheet is separated, the drive rollers 84, 86 are caused to again rotate thereby moving the next sheet from the continuous stock in position to be separated and also sending the previously cut discrete sheet from the producer/feeder mechanism 16 through the feed opening of the tray 20 inserted in the laser printer assembly 12.

The separated discrete sheet 14" which was cut from the free end of the continuous stack 18 is transported by the feedout rollers 86, 87 away from the cutting blade 76 at a feed-out speed which is greater than a feed-in speed. This creates a gap 112, FIG. 9, between the lagging edge 95 of the discrete sheet 14" and a leading edge 96 of the continuous stock from which the discrete sheet is cut. The rotation of the feed-out drive roller 86 relative to the slower rotating larger feed-in drive roller 84 places a strain on the continuous stock 18 when the continuous stock is engaged by both rollers which places the paper stock in a taut condition to facilitate cutting of the continuous paper stock into discrete sheets by the discrete sheet cutter 76, as seen in FIG. 8. The exit or feed-out rollers 86, 87 eject the previously cut discrete sheet 14" through and out of an exit slot located at a preselected level at the continuous discrete sheet producer/feeder 16 and defined by the region between the feed-out rollers 86, 87 and into the open end of the tray 20. The faster rotating feed-out drive roller 86 relative to the larger feed-in roller 84 accounts for a time delay between the ejection of an already cut and ejected discrete sheet 14", FIG. 7, whereby the time delay corresponds to the gap 112, FIG. 9, between the lagging edge 95 of the discrete sheet and the leading edge 96 of the continuous stock. This time delay is sufficiently long to enable each cut discrete sheet 14" to fall beneath the preselected level of the exit slot, toward the open tray 20 and out of the path of ejection of a next successive sheet being ejected, as seen in FIGS. 6 and 7.

The tray 20 as previously discussed has an open back end which acts as a feed opening for discrete sheets ejected from the feed-out roller 86, 87 of the discrete sheet producer/feeder 16. The feed opening at the open end of the tray 20 is aligned and closely positioned with the exit slot of the feed-out rollers 86, 87 to enable substantially horizontal receipt of the separated discrete sheets 14" as they are ejected into the open tray by the feed-out rollers. Alternatively, the removably mounted open tray has four rectilinear walls and a base assembly in which the feed opening of the tray is defined by an opening at the top of the tray which is opposite the base assembly. In the embodiment of the four walled open tray, the tray is not entirely housed within the laser printer assembly apparatus 12 as in FIGS. 6 and 7, but rather has a portion of the open tray which extends out from the body of the laser printer assembly apparatus. The open tray having the four rectilinear walls and an open top acting as the feed opening received discrete sheets expelled from the exit rollers 86, 87 of the discrete sheet producer feeder 16 through the top feed opening extends outward from the body of the laser printer assembly 12 and is thereby accessible for receipt of discrete sheets into the tray through the top when the tray is mounted within the tray receptacle. The feed-out rollers 86, 87 defining the exit slot for discrete sheets in the embodiment of FIGS. 6 and 7 is enabled to be properly aligned with the feed opening at the open end of the tray by means of an alignment member 97 secured to the discrete sheet producer feeder 16. The alignment member 97 has an elongate portion 98 extending from the discrete sheet producer feeder 16 which is contoured for receipt of the bottom side and edge surface of the discrete sheet laser printer 12. The elongate portion 98 of the alignment member 97 also has a plurality of pegs 99 which extend into mating receipt with a plurality of corresponding bore holes at the bottom surface of the discrete sheet printer 12. Upon the pegs 99 being matingly inserted into the corresponding holes at the bottom of the printer and the elongate portion is in aligned position with the bottom and side surfaces of the printer, the exit slot for the feed-out rollers 86, 88 of the sheet producer/feeder 16 is the proper alignment with the feed opening of the open tray 20 positioned within the discrete sheet printer 12.

The cylindrical feed-out drive roller 86 has on its surface a plurality of elongate grooves 100 to aid in properly expelling the discrete sheets 14" into the open tray 20 and to prevent any excess paper tears from the cut perforations of the separated discrete sheet from becoming entangled with the fast moving feed-out drive roller. The employment of the elongate grooves 100 in the cylindrical feed-out drive roller 86 to push the back edge of the cut discrete sheet as well as rotating the roller at a sufficiently high rate of speed enables the discrete sheets to be properly ejected from the exit slot of the rollers 86, 87 through the air and into the open tray 20. The drive roller 84 and 86 transport the paper stock through the producer/feeder 16 and transfer a cut sheet to the open tray. The corresponding tension rollers 85 and 87 ride above the top of the drive rollers 84, 86 to place tension on the printable stock transported therebetween. Each of the tension rollers is eccentrically mounted by means of an eccentric member 101 in order to enable adjustment of the space between the drive rollers and tension rollers for printable stock of varying thickness and to allow different levels of tension to be applied thereon.

FIGS. 6 and 7 also illustrate an alternative form of the resilient sheet support mechanism 46, seen and described in FIGS. 3A and 3B, by providing an elongate sheet support mechanism 80 which extends laterally from the discrete sheet producer and feeder 16 through the open end of the removable tray 20 at a distance above the base bottom 50 of the tray proximate the open end 60 to support a free end 96, as seen in FIG. 7, of a discrete sheet which is partially inserted within the removable tray. By supporting and elevating the free end 96 of the partially inserted sheet, the tray 20 is enabled to be readily removed and inserted back into the tray receptacle within the laser printer assembly 12 without damaging or crumpling the partially inserted sheet which otherwise would hang below the level of the base at the one end of the tray and cause difficulties upon insertion of the tray into the tray receptacle. The operation of the alternative elongate sheet support mechanism which acts as a plate to elevate a partially inserted sheet into the sheet printing assembly 12 overcomes the problems in much the same manner as the other resilient sheet support mechanism 46 as described in FIGS. 3A and 3B.

As seen in FIG. 6, the lagging end 95 of the separated discrete sheet 14" is being ejected by the feed-out rollers 86, 87 through the exit slot and into open back end 60 of the removable paper tray 20 at the printing assembly 12. The free end 96 of the continuous stock is still in the process of being transferred through the discrete sheet producer/feeder 16 by the feed-in rollers 84, 85 and moved towards the feed-out rollers 86, 87 until it is in position for the next sheet to be cut therefrom. The separated discrete sheet 14" is ejected into the open paper tray 20 towards a discrete sheet transport mechanism 22 which is preferably a pick-up roller or any other suitable means which transports individual sheets in the paper tray to a printing mechanism 30 which performs the actual printing of characters on the sheet within the discrete sheet laser printer apparatus 12.

Referring again to FIG. 7, the automatic continuously fed, sheet printer assembly 10 is shown with the cut discrete sheet 14" completely inserted within the open tray 20 and in position to be removed by the pick-up roller or discrete sheet transport mechanism 22 for printing at the printing mechanism 30 within the laser printer apparatus 12. The next successive sheet 14' from the continuous fan fold of paper stock 18 is shown in position to be cut whereby the perforated edges 94 of the attached fan fold sheet 14' are in alignment with the cutting member 76, as clearly illustrated in FIG. 8. The individual discrete sheets are inserted seriatim through the feed opening adjacent the open end of the paper tray 20 by the operation of the rollers as previously discussed. As seen in FIGS. 7 and 8, sheet 14' when in position to be separated from the continuous supply 18 is partially inserted within the removable open tray 20 while the previously separated discrete sheet 14" remains within the removable tray.

The sheet support mechanism 80 seen in the embodiment of FIG. 7, has a sheet support member 102 carried by the discrete sheet producer/feeder 16 which extends through the feed opening and partially into the removable open tray 20 to support the free end 96 of sheet 14' which is partially inserted within the removable open tray. The next successive sheet 14' to be cut is partially inserted into the open tray 20 after the previous discrete sheet 14" has been ejected into the open tray and fallen out of the path of ejection by feed-out rollers 86, 87. Sheet 14' is also partially inserted into the tray 20 prior to the previously cut discrete sheet 14" having been removed from the tray by the transport mechanism 22. Thus, when discrete sheet 14" is awaiting to be removed for printing by the transport mechanism 22 and has its lagging end section 95 being supported by the sheet support member 102 (in the embodiment of FIG. 7), the leading end section 96 of sheet 14' is inserted through the feed opening and into the open tray 20 whereby the leading end 96 section of sheet 14' lays atop of the lagging end section 95.

The feed-out rollers 86, 87 automatically feed a portion of sheet 14' into the removable open tray 20 prior to the tray becoming empty. The sheet support member 102 carried by the continuous discrete sheet producer/feeder 16 which is inserted through the open end 60 and into the open tray supports both the lagging end section 95 of sheet 14" and the leading end section 96 of sheet 14' above the bottom surface 50 of the removable open tray 20. When discrete sheet 14" is removed form the tray 20 by the discrete sheet transport mechanism 22 for printing, the next successive sheet 14' is being cut from the continuous stock 18 when in the position seen in FIG. 7. Once sheet 14' is separated from the supply of continuous paper stock 18, the exit or feed-out rollers 86, 87 transfer the remainder of the sheet into the open tray 20. The feed-in rollers 84, 85 then automatically transport the next sheets in the continuous fan fold guided through the sheet production path in a seriatim manner to position them one after another for cutting.

Referring now to FIG. 8, the first paper sheet 14" is seen being separated into a discrete sheet as the discrete sheet separator 76 moves horizontally across the perforation lines segmenting sheet 14" from the next subsequent sheet 14' of the continuous fan fold of printable stock. A sensor hole or other suitable light sensor marking on sheet 14' much like the hole 105 of sheet 14" is sensed as sheet 14' is transported through the discrete sheet producer/feeder 16 by rollers 84, 85. When the sensor hole of sheet 14' which is directly below the position sensor 74 is sensed by the sensor, this indicates that the discrete sheet cutter 76 is in alignment with perforated edges segmenting the lagging edge 95 of sheet 14" and the leading edge 96 of sheet 14'. The position sensor 74 signals the central controller 72, FIG. 4, to temporarily cease the rotation of the drive rollers 84, 86.

The motor 88 is signalled to temporarily stop thereby ceasing rotation of the drive shafts 89, 90 interconnected by sprockets 91, 92 and belt 93. When the sheets are temporarily prevented from moving through the producer feeder mechanism 16, the central controller causes the discrete sheet cutter 76 to move in the direction of arrow 110 thereby separating sheet 14" from sheet 14' of the continuous paper stock. Since feed-out rollers 86, 87 lead the perforated lines 94 and feed-in rollers 84, 85 lag the perforated lines when in the cutting position of FIG. 8, and the leading feed-out rollers rotate at a faster rate than the lagging feed-in rollers, sheets 14' and 14" of the continuous stock are strained to provide a taut condition to facilitate cutting as the cutting member or blade 76 moves across the perforated lines. The signalling action between the sensor hole 105 on sheet 14' and the sensor detector to actuate the operations of the motor, rollers and the cutting blade, enables the continuous paper stock (in either a fan folded or rolled form) to be cut into uniformly sized discrete sheets of printable stock. Preferably, the positioning of the sensor hole 105 or other suitable marking is placed in the same lo cation relative to the perforated lines or sheet edges for each sheet to be cut thereby promoting the cutting of uniformly sized sheets.

Referring to FIG. 9, the continuous discrete sheet producer feeder 16 is shown with the leading sheet 14" being completely separated from the sheet 14' of the continuous paper stock. Once the discrete sheet 14" has been separated by the cutting blade 76 moving completely across the width of the paper, the motor 88 is caused to run and the associated rollers 84, 85, 86, 87 rotate once again. The cutting blade 76 is caused to move in the opposite direction when cutting the next subsequent sheet 14'. Feed-out rollers 86, 87 continue to transfer the discrete sheet 14" through the producer feeder and eject the discrete sheet into the open tray 20 through its feed opening as the sheet exits the feed-out rollers. The feed-in rollers 84, 85 continue to transport the next successive sheet 14' until it is sensed to be in position to be separated from the continuous stock. As previously discussed, the feed-out drive rollers 86 rotate at a faster rate than the feed-in drive roller 84 which causes the discrete sheet 14" to be ejected from the discrete sheet producer feeder 16 and into the open tray 20 faster than the next successive sheet 141 is moved by feed-in rollers through the discrete sheet producer feeder. This accounts for a spatial gap 112 to be created between the discrete sheet 14" and sheet 14' of the continuous stock prior to the discrete sheet 14" being completely ejected by the feed-out rollers.

While a detailed description of the preferred embodiment of the invention has been given, it should be appreciated that many variations can be made thereto without departing from the scope of the invention as set forth in the appended claims.

We claim:

1. In a printing assembly having a discrete sheet printer with a discrete sheet supply tray and means for automatically transporting a discrete sheet from the supply tray to the printer for printing, the improvement being a continuous discrete sheet supply enhancement apparatus, comprising:

an open tray for receipt through space of at least one discrete sheet;

means for cutting a supply of continuous stock into discrete sheets;

means for transferring a free end of the continuous stock to the cutting means at a feed-in speed; and means for ejecting a discrete sheet cut from the free end of the continuous stock away from the cutting means with a falling trajectory, through space, that moves the discrete sheets into the open tray for operative engagement with the discrete sheet transporting means of the printer, said ejecting means including means for ejecting the discrete sheets into space at a feed-out speed greater than the feed-in speed, and said feed-out speed being sufficiently greater than the feed-in speed to create a gap through space between successive discrete sheets, said gap being of sufficient gap width to enable each discrete sheet to fall sufficiently in its falling trajectory before a next successive sheet is ejected to avoid collision between successively ejected discrete sheets.

2. The printing assembly of claim 1 in which said ejecting means includes a cylindrical roller with a plurality of elongate grooves engageable with back edges of discrete sheets to push the back edges during ejection of the discrete sheets, and means for rotating the cylindrical roller at the feed-out speed to push the discrete sheets through space and into the open tray.

3. The printing assembly of claim 1 in which said transporting means and said transferring means respectively include first and second rollers engageable with the stock and means for driving the rollers to rotate at said feed-in and said feed-out speeds, respectively.

4. The printing assembly of claim 1 in which said open tray has an end with a feed opening for substantially horizontal receipt of the discrete sheets from said ejecting means, and a discrete sheet support surface located beneath a level at which the discrete sheets are ejected by the ejecting means.

5. The printing assembly of claim 1 in which at least one of said ejecting means includes a pair of rollers with a gap for receipt of said stock, and means for adjusting the gap including an eccentric axle member to which at least one of the rollers is mounted for eccentric rotation.

* * * * *